US006665995B2

(12) United States Patent
Deane

(10) Patent No.: US 6,665,995 B2
(45) **Date of Patent: *Dec. 23, 2003**

(54) RUBBER CORE SPACER WITH CENTRAL CORD

(75) Inventor: Robert J. Deane, Grafton (CA)

(73) Assignee: AFG Industries, Inc., Kingsport, TN (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/173,168

(22) Filed: Jun. 18, 2002

(65) Prior Publication Data

US 2003/0029134 A1 Feb. 13, 2003

Related U.S. Application Data

(63) Continuation-in-part of application No. 09/421,504, filed on Oct. 20, 1999, now Pat. No. 6,434,910.
(60) Provisional application No. 60/115,953, filed on Jan. 14, 1999.

(51) Int. Cl.[7] ..... E04C 2/54
(52) U.S. Cl. ..... 52/786.13
(58) Field of Search ..... 52/309.7, 309.15, 52/309.16, 786.11, 786.13; 428/34

(56) References Cited

U.S. PATENT DOCUMENTS

| | | | | |
|---|---|---|---|---|
| 1,681,942 A | * | 8/1928 | Ledwinka | 277/651 |
| 3,186,042 A | * | 6/1965 | Daley | 277/651 |
| 3,399,294 A | | 8/1968 | Thieben | 52/759.13 X |
| 3,573,149 A | | 3/1971 | Tibble et al. | 52/786.13 X |
| 3,965,638 A | | 6/1976 | Newman | 52/786.13 |
| 4,658,553 A | | 4/1987 | Shinagawa | |
| 4,720,950 A | | 1/1988 | Bayer et al. | 52/786.13 |
| 5,260,112 A | | 11/1993 | Grether et al. | |
| 5,466,534 A | | 11/1995 | Newby | |
| 5,806,272 A | | 9/1998 | Lafond | 52/786.13 |
| 5,851,609 A | | 12/1998 | Baratuci et al. | 428/34 |
| 6,105,972 A | * | 8/2000 | Guzowski | 277/604 |
| 6,173,967 B1 | * | 1/2001 | Eskew et al. | 277/606 |

FOREIGN PATENT DOCUMENTS

DE 1 534 834 7/1969

* cited by examiner

*Primary Examiner*—Peter R. Brown
(74) *Attorney, Agent, or Firm*—Oblon, Spivak, McClelland, Maier & Neustadt, P.C.

(57) ABSTRACT

Two parallel glass panes are separated by a core spacer made of either EPDM rubber or another solid rubber material with a nonheating, centrally positioned, nonstretchable fiberglass cord being embedded therein and extending longitudinally therethrough so that the core spacer is not stretchable. The EPDM rubber formulation is chemically compatible with hot melt butyl which is used as an adhesive between the solid rubber and the glass panes. The fiberglass cord is nonstretchable so that the core spacer does not deform or break apart when the core spacer is either initially manufactured or later placed between the pair of two glass panes. The core spacer and the cord extend around a periphery and go around corners between the panes in an airtight manner to form an insulated assembly. Also, the cord has a diameter no greater than about 10% of a width of the core spacer. A method for manufacturing the insulated assembly is likewise disclosed.

14 Claims, 6 Drawing Sheets

RUBBER CORE SPACER WITH CENTRAL CORD

CROSS REFERENCE TO RELATED APPLICATIONS

This application is a continuation-in-part of U.S. patent application Ser. No. 09/421,504, filed on Oct. 20, 1999 U.S. Pat. No. 6,434,910, which claims priority from U.S. Provisional Patent Application Ser. No. 60/115,953 filed on Jan. 14, 1999.

BACKGROUND OF THE INVENTION

1. Field of the Invention

The invention relates to an insulated glass assembly and, in particular, to core spacers separating glass panes.

2. Description of the Related Art

Insulating glass is usually made of at least two panes adhered together along their edges by a core spacer. In the prior art, there are several types of core spacers manufactured from synthetic foam which is soft and easily compressed. Exemplary is the spacer shown in U.S. Pat. No. 5,806,272 which was issued to Lafond on Sept. 15, 1998.

However, such foam core spacers have minimal stability because of their easy compressibility. Furthermore, such foam spacers are readily stretched longitudinally, thus allowing them to be deformed or broken apart before, during or after installation in a window frame.

Another disadvantage of foam core spacers is that they often interact chemically with hot melt butyl, thus causing a stain discoloration which is unacceptable aesthetically. Such a chemical reaction further frequently causes a variety of other problems, like a change in adhesion strength, a shrinkage of the foam spacer, or an expansion thereof. Whenever a shrinkage occurs, the spacer tends to pull away from the corners where the glass panes are joined together. Likewise, if an expansion occurs, the foam spacer becomes misshapen and appears unattractive.

SUMMARY OF THE INVENTION

A solid EPDM rubber core spacer is provided with a centrally positioned, nonstretchable cord made of fiberglass or similar material for imparting strength thereto. Furthermore, the EPDM rubber formulation is chemically compatible with hot melt butyl which is used as an adhesive and as a moisture vapor barrier. Although there are many differences between the hot melt butyls manufactured by different companies, it is important to formulate an EPDM rubber which ensures chemical compatibility.

A key advantage of the present invention is improved stability over foam core spacers when in compression during oven pressing, packing, shipping, and installing in windows. In each situation, the solid rubber core spacer undergoes significantly less compression than the foam of the prior art spacers.

Another advantage of the present invention is the incorporation of the fiberglass cord into the rubber core spacer so that no stretching of the spacer occurs during initial manufacture, spacer assembly, coiling of the spacer, and application of the finished spacer between two glass panes. Also, heating and cooling of the spacer does not result in any deformation or breakage of the spacer when in use because of the presence of the continuous nonstretchable fiberglass cord incorporated therein. Of course, in the real world, everything can be stretched to a breaking point if a powerful enough pulling force is exerted. In that sense, the fiberglass cord is nonstretchable under normal conditions of use.

A further advantage of the present invention is that the chemical composition of the EPDM rubber in the core spacer is such that it does not react, other than in a minimally inconsequential way, with hot melt butyl. Thus, this feature of the present invention prevents a chemical reaction that could cause a stain discoloration, a change of adhesion strength, shrinkage, expansion or any other disadvantage inherent in the prior art foam core spacers whenever a chemical reaction takes place.

DETAILED DESCRIPTION OF THE INVENTION

Figure 1:
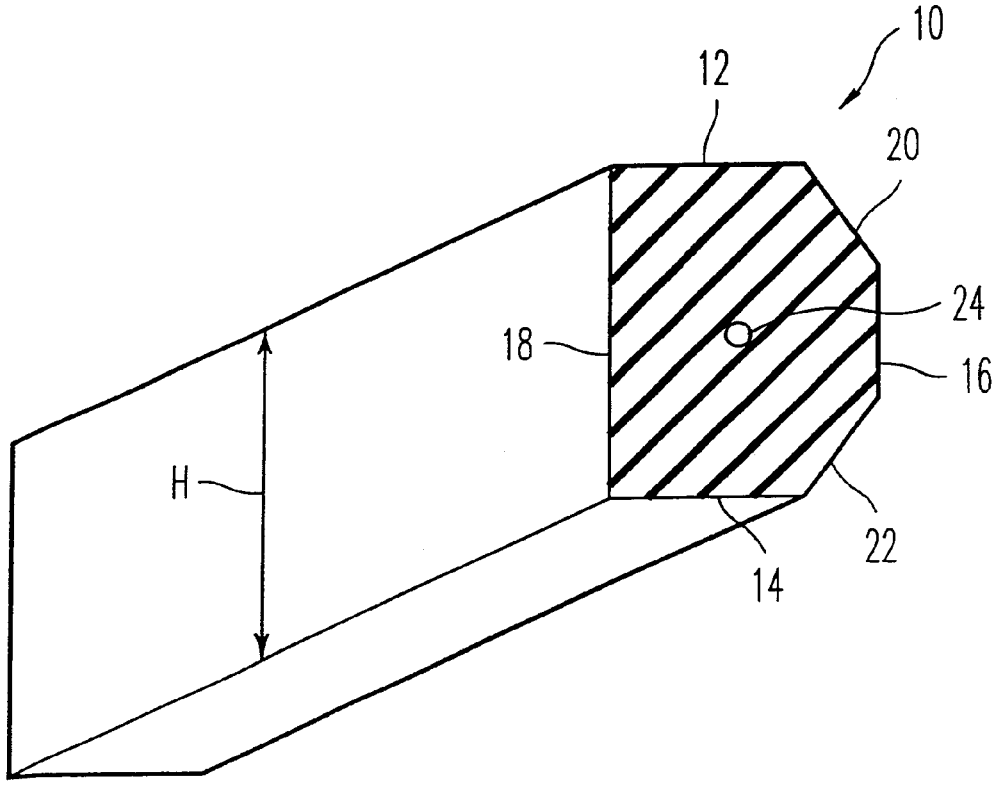
FIG. 1 is a perspective view of a first embodiment of the present invention.

In FIG. 1, a first embodiment of a rubber core spacer 10, noncircular in shape, is shown with a top side 12, a bottom side 14, a short side 16, a long side 18, and two diagonally cut corners 20 and 22. A single, nonheating, nonstretchable, centrally positioned fiberglass cord 24 is embedded in the rubber core spacer 10 when the latter is manufactured so that the core spacer 10 is not stretchable. The preferred rubber formulation for the spacer 10 is an ethylene propylene diene monomer (EPDM) polymer with fillers. However, other solid rubber materials may be suitable.

The height H varies according to the width selected for the spacer 10. Thus, the height H may range from as little as one quarter to three quarters of an inch or greater.

The cord 24 is cylindrical in shape and has a diameter of at least 0.01 inch which is sufficient for the cord 24 to be effective inside the spacer 10. However, the preferred diameter is 0.02 inch. In FIG. 1, it can be seen that the cord 24 has its diameter no greater than about 10% of the width of the spacer 10.

Figure 2:
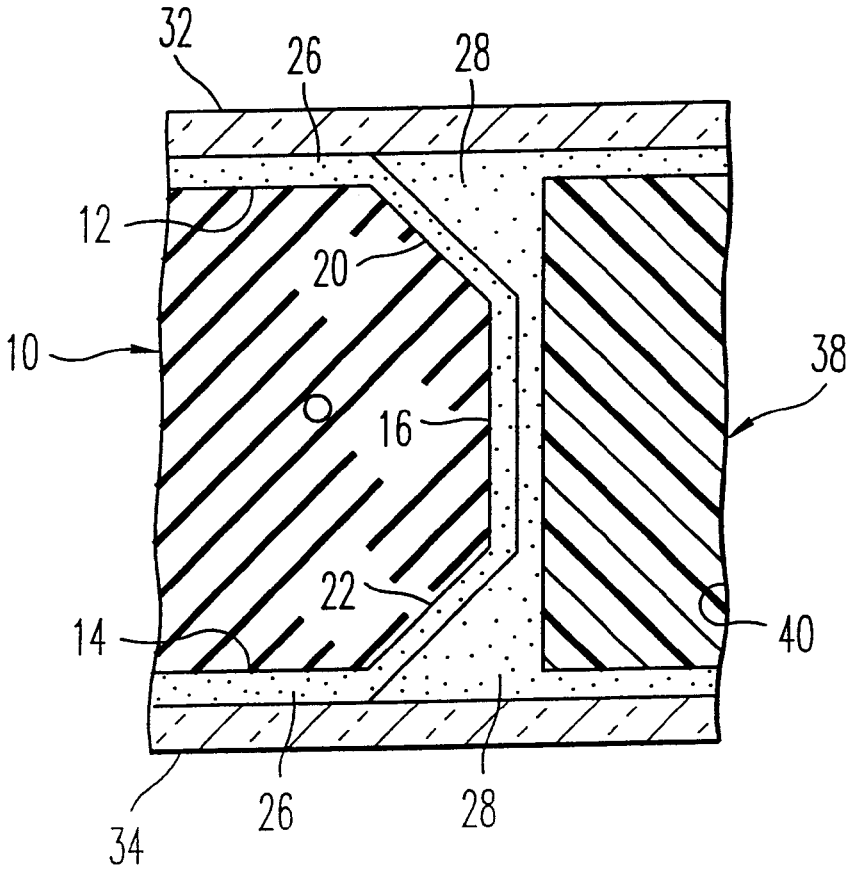
FIG. 2 is a side elevational view of the first embodiment.

In FIG. 2, a first hot butyl melt adhesive 26 is applied around at least two sides, but preferably the three sides 12, 14, 16 and the corners 20 and 22 of the core spacer 10, although it is sufficient to be applied around only the top side 12 and the bottom side 14. This first adhesive 26 sticks the core spacer 10 between a pair composed of a top glass pane 32 and a bottom glass pane 34. These glass panes 32 and 34 are flat sheets that are parallel to each other. After the first adhesive 26 is positioned, a desiccant 38 is arranged adjacent to the core spacer 10 and is spaced between the pair of parallel panes 32 and 34 by a second hot butyl melt adhesive 28 which is applied around at least two sides and preferably three sides of the desiccant 38 to hold the desiccant 38 between the pair of parallel panes 32 and 34. This desiccant 38 is a drying agent intended to absorb any moisture between the panes 32 and 34 and is open on one side 40 to the space separating the panes 32 and 34. Desiccants are well known in the prior art and many types may be suitable.

Figure 3:
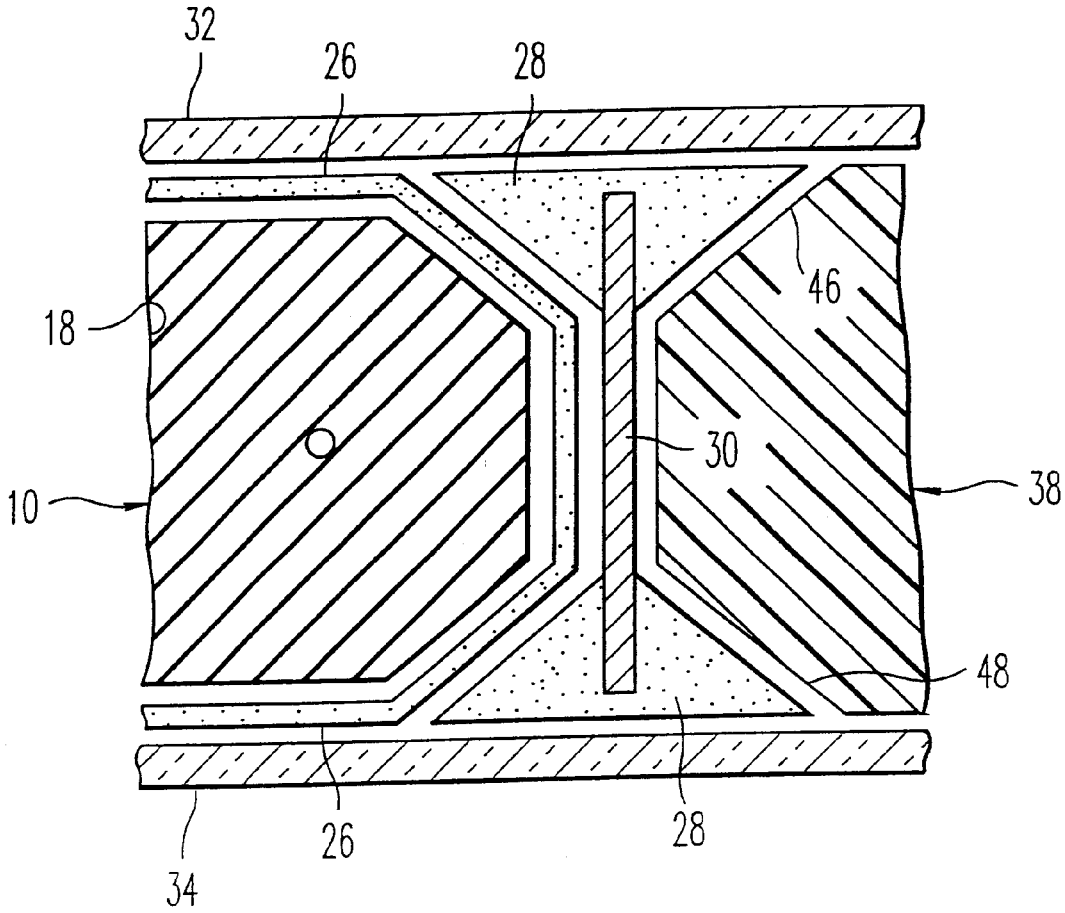
FIG. 3 is an exploded side elevational view of a second embodiment.

In FIG. 3, a second embodiment is shown in an exploded view in which the desiccant 38 has cut corners 46 and 48 to help the second adhesive 28 hold a vapor barrier 30 in place between the core spacer 10 and the desiccant 38. The vapor barrier 30 may be a metallized plastic film embedded at both ends in the second adhesive 28. The core spacer 10 remains in the same position, surrounded on all sides, except for the long side 18, by the first adhesive 26. The two panes 32 and 34, as in the first embodiment seen in FIGS. 1 and 2, are held apart by the core spacer 10 while the desiccant 38 absorbs any moisture in the space therebetween.

Figure 4A:
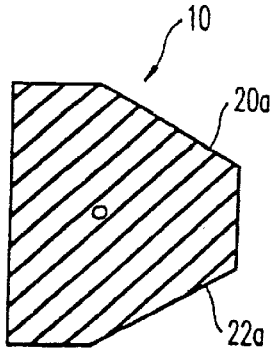
FIG. 4*a* is a side elevational view of a third embodiment.

In FIG. 4*a,* a third embodiment is shown in which the spacer 10 has its corners 20*a* and 22*a* cut longer than the corners 20 and 22 seen in the first embodiment of FIGS. 1 and 2.

Figure 4B:
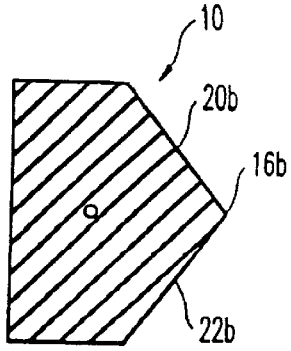
FIG. 4*b* is a side elevational view of a fourth embodiment.

In FIG. 4*b,* a fourth embodiment is shown in which corners 20*b* and 22*b* of the spacer 10 come to a point 16*b* instead of to the side 16, as seen in the first embodiment of FIGS. 1–2.

FIGS. 4*c* through 4*g* show further embodiments in which patterns are cut into the top side 12 and the bottom side 14 of the spacer 10 to form voids for a purpose to be described.

Figure 4C:
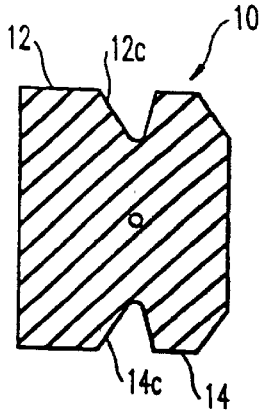
FIG. 4*c* is a side elevational view of a fifth embodiment.

In FIG. 4*c,* a fifth embodiment is shown in which the spacer 10 has triangular indentations 12*c* and 14*c* in the top side 12 and the bottom side 14, respectively.

Figure 4D:
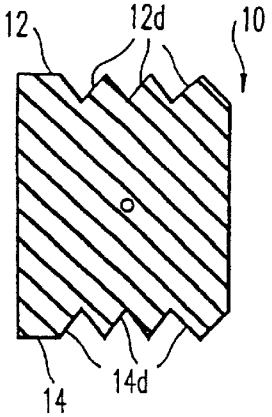
FIG. 4*d* is a side elevational view of a sixth embodiment.

In FIG. 4*d,* a sixth embodiment is shown in which the spacer 10 has a plurality of serrated teeth 12*d* and 14*d* in the top side 12 and the bottom side 14, respectively.

Figure 4E:
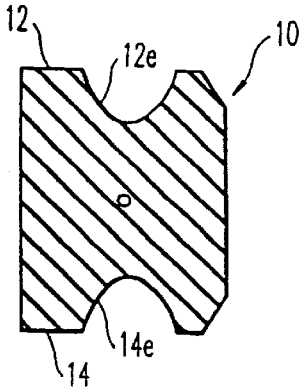
FIG. 4*e* is a side elevational view of a seventh embodiment.

In FIG. 4*e,* a seventh embodiment is shown in which the spacer 10 has scalloped recesses 12*e* and 14*e* in the top side 12 and the bottom side 14, respectively.

Figure 4F:
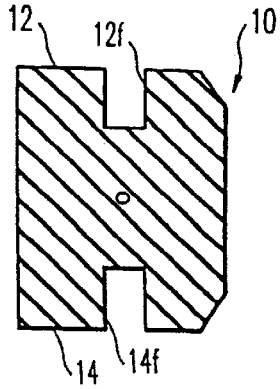
FIG. 4*f* is a side elevational view of an eighth embodiment.

In FIG. 4*f,* an eighth embodiment is shown in which the spacer 10 has deep grooves 12*f* and 14*f* in the top side 12 and the bottom side 14, respectively.

Figure 4G:
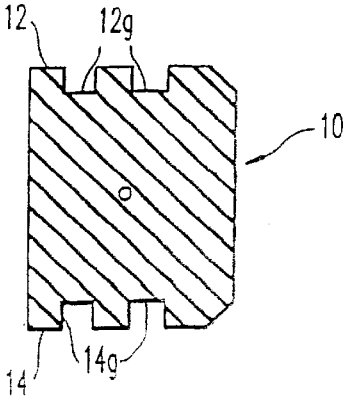
FIG. 4*g* is a side elevational view of a ninth embodiment.

In FIG. 4*g,* a ninth embodiment is shown in which the spacer 10 has a plurality of shallow channels 12*g* and 14*g* in the top side 12 and the bottom side 14, respectively.

Figure 4H:
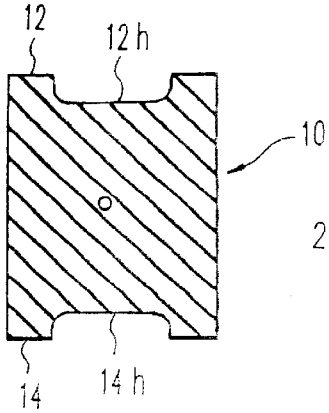
FIG. 4*h* is a side elevational view of a tenth embodiment.

In FIG. 4*h,* a tenth embodiment is shown in which the spacer 10 has wide depressions 12*h* and 14*h* in the top side 12 and the bottom side 14, respectively. However, unlike the embodiments shown in FIGS. 4*a* through 4*g,* the spacer 10 in FIG. 4*h* does not have any cut diagonal corners.

The purpose of the indentations 12*c* and 14*c* in FIG. 4*c,* the teeth 12*d* and 14*d* in FIG. 4*d,* the recesses 12*e* and 14*e* in FIG. 4*e,* the grooves 12*f* and 14*f* in FIG. 4*f,* the channels 12*g* and 14*g* in FIG. 4*g,* and the depressions 12*h* and 14*h* in FIG. 4*h,* is to allow the first adhesive 26 illustrated in FIGS. 1–3 to fill the voids therein so that the adhesive 26 sticks better to the spacer 10 and to the glass panes 32 and 34 of FIGS. 1–3.

Figure 4I:
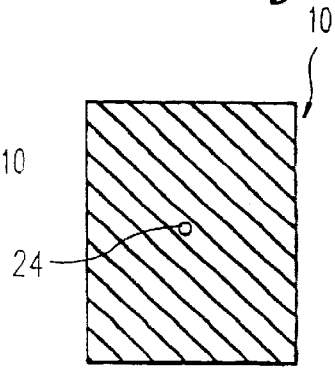
FIG. 4*i* is a side elevational view of an eleventh embodiment.

In FIG. 4*i,* an eleventh embodiment is shown in which the spacer 10 has a rectangular cross section through which the cord 24 is centrally positioned. Note that there are no diagonally cut corners and no indentations.

Figure 5:
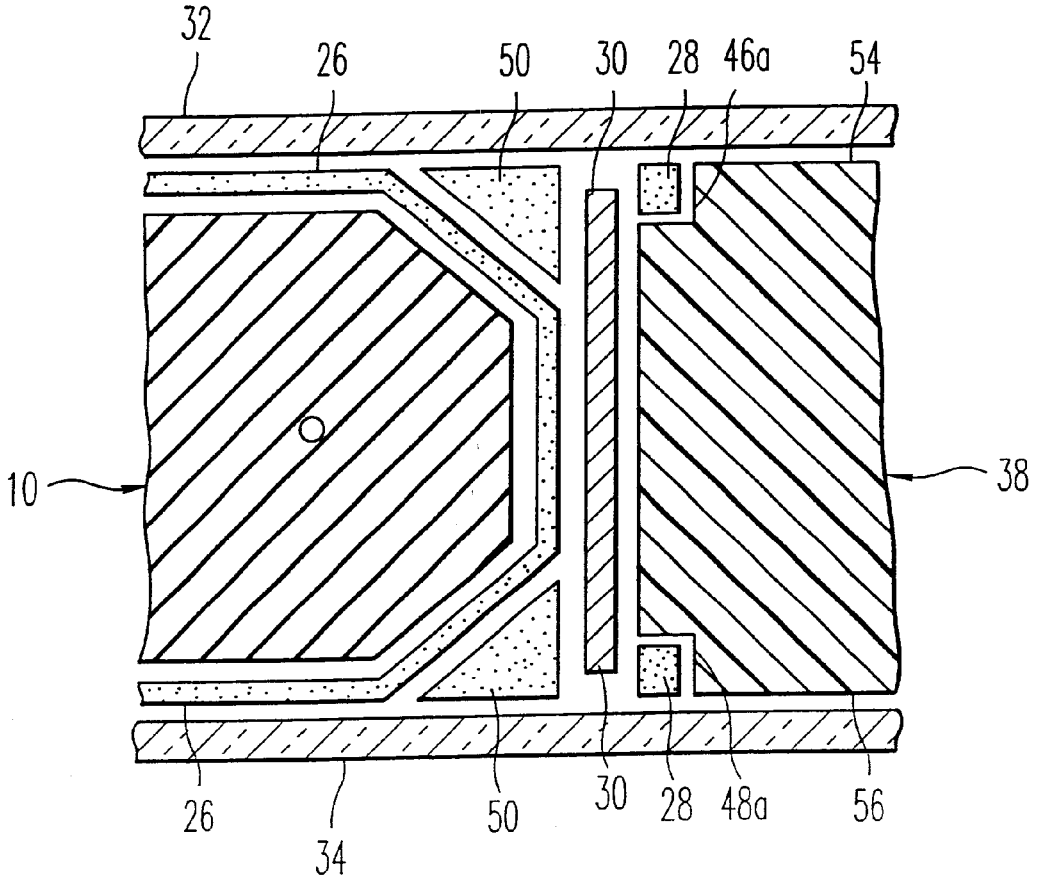
FIG. 5 is an exploded side elevational view of a twelfth embodiment.

In FIG. 5, a twelfth embodiment is shown in which a third hot melt butyl adhesive 50 is applied between the first adhesive 26 and the vapor barrier 30 to orient the vapor barrier 30 at both ends perpendicular to the pair of parallel glass panes 32 and 34. The amount of the second adhesive 28 used is less than the amount used in the second embodiment of FIG. 3. The third adhesive 50 may be uncured silicone or urethane.

Also, instead of the diagonally cut corners 46 and 48 of FIG. 3, the twelfth embodiment in FIG. 5 has smaller square cut corners 46*a* and 48*a* so that the desiccant 38 is left with a top surface 54 and a bottom surface 56 which provide additional frictional engagement with the top glass pane 32 and the bottom glass pane 34, respectively. In this twelfth embodiment, the six-sided spacer 10 is the same size as the spacer 10, shown in the first and second embodiments of FIGS. 1–3, with the top surface 54, the bottom surface 56, two other sides, and at least two cut corners 46*a* and 48*a*. In other words, the top surface 54 and the bottom surface 56 of the core spacer 10 have a pattern cut therein, as seen in FIG. 5, to form voids which receive the second adhesive 28. This pattern may be described as a plurality of shallow channels.

When heat is applied to cure the third adhesive 50, the entire assembly of FIG. 5 has more structural integrity because the cured third adhesive 50 attaches itself firmly to the second adhesive 26, the metallized vapor barrier 30, and both glass panes 32 and 34.

Figure 6:
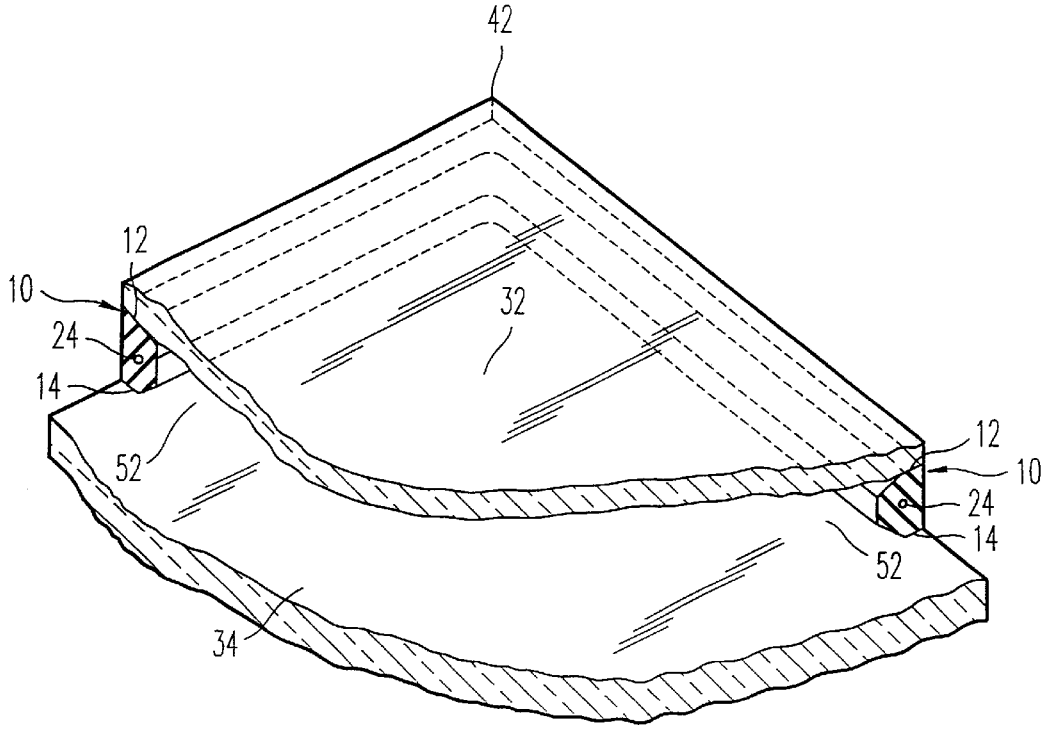
FIG. 6 is a perspective view of the first embodiment.

In FIG. 6, the first embodiment of FIGS. 1 and 2 is shown in place, without the second adhesive 28 and the desiccant 38, for ease of illustration. The spacer 10 is adhered at its top side 12 to the top glass pane 32 and also is adhered at its bottom side 14 to the bottom glass pane 34. The glass panes 32 and 34 are parallel to each other but are separated by an interior space 52 to form an entire insulated glass assembly. The spacer 10 and the core 24 extend around the entire periphery and go around corners between the panes 32 and 34 in an airtight manner to form the entire insulated glass assembly. At a 90° corner 42, either the spacer 10 is flexed, thus causing some curvature in the corner 42, or the spacer 10 is cut, thus allowing a sharp 90° corner 42 to be formed. In the latter case, an exterior corner void is back-filled with the adhesive 26, as shown in the embodiments of FIGS. 2, 3 and 5. Note that it is necessary to cut only the spacer 10 and not any other materials, such as the second adhesive 28 and the desiccant 38 in FIG. 2 or the same two materials and the vapor barrier 30 in FIG. 3, or the three last listed materials and the adhesive 50 in FIG. 5. Consequently, the nonstretchable fiberglass cord 24 running therethrough allows the rubber spacer 10 to maintain its structural integrity by preventing the rubber spacer 10 from stretching. Thus, the entire insulated glass assembly is kept intact so that no moisture enters the interior space 52 between the panes 32 and 34.

The present invention also encompasses a method for manufacturing the insulated assembly having the interior space. The method includes an initial step of providing the pair of parallel glass panes 32 and 34 separated by the interior space. The method also includes the further steps of embedding the nonheating, nonstretchable cord 24 in a central position of the rubber core spacer so that the rubber core spacer 10 is not stretchable; applying the first adhesive 26 around at least two sides of the core spacer 10 for sticking the core spacer 10 between the pair of parallel glass panes 32 and 34; arranging the desiccant 38 adjacent to the core spacer 10 and spacing the desiccant 38 between the pair of parallel glass panes 32 and 34; applying the second adhesive 28 around at least two sides of the desiccant 38 to hold the desiccant 38 between the pair of parallel glass panes 32 and 34; holding the vapor barrier 30 in place between the core spacer 10 and the desiccant 38; and applying the third adhesive 50 between the first adhesive 26 and the vapor barrier 30 to orient the vapor barrier 30 at both ends perpendicular to the pair of parallel glass panes 32 and 34. The last step is extending the core spacer 10 and the cord 24 around the periphery and around the corners between the pair of parallel glass panes 32 and 34 in an airtight manner to form the insulated assembly. In the completed assembly, as best shown in FIGS. 3 and 6, the cord 24 has a diameter no greater than about 10% of the width of the core spacer 10.

The above-described embodiments are not limiting, but can be modified in various ways within the scope and spirit of the present invention.

I claim:

1. An insulated assembly having an interior space, comprising:

a pair of parallel panes separated by the interior space; and a core spacer with a nonheating, centrally positioned, nonstretchable cord embedded therein so that the core spacer is not stretchable;

wherein the spacer and the cord extend around a periphery and go around corners between the panes in an airtight manner to form the insulated assembly; and wherein the cord has a diameter no greater than about 10% of a width of the core spacer.

2. An insulated assembly, according to claim 1, wherein:

said core spacer has a height between one quarter and three quarters of an inch and said cord has a diameter of at least 0.01 inch.

3. An insulated assembly according to claim 1, wherein:

said parallel panes are flat sheets;

said core spacer is noncircular in shape; and said cord is cylindrical in shape.

4. An insulated assembly, according to claim 3, wherein:

said flat sheets are made of glass;

said core spacer is made of rubber; and said cord is made of fiberglass.

5. An insulated assembly, according to claim 1, wherein:

said core spacer is six-sided in shape with a top side, a bottom side, two other sides, and at least two cut corners.

6. An insulated assembly, according to claim 5, wherein:

said top side and said bottom side of the core spacer have a pattern cut therein to form voids.

7. An insulated assembly, according to claim 6, wherein:

said pattern is a plurality of shallow channels.

8. An insulated assembly, according to claim 1, wherein:

said cord has its diameter no greater than about 0.02 inch.

9. A method for manufacturing an insulated assembly having an interior space, said method comprising the steps of:

providing a pair of parallel panes separated by the interior space;

embedding a nonheating, nonstretchable cord in a central position of a core spacer so that the core spacer is not stretchable; and extending the core spacer and the cord around a periphery and around corners between the panes in an airtight manner to form the insulated assembly;

wherein the cord has a diameter no greater than about 10% of a width of the core spacer.

10. A method according to claim 9, further comprising the step of:

applying a first adhesive around at least two sides of the core spacer for sticking the core spacer between the pair of parallel panes.

11. A method according to claim 10, further comprising the step of:

arranging a desiccant adjacent to the core spacer and spacing the desiccant between the pair of parallel panes.

12. A method according to claim 11, further comprising the step of:

applying a second adhesive around at least two sides of the desiccant to hold the desiccant between the pair of parallel panes.

13. A method according to claim 12, further comprising the step of:

holding a vapor barrier in place between the core spacer and the desiccant.

14. A method according to claim 13, further comprising the step of:

applying a third adhesive between the first adhesive and the vapor barrier to orient the vapor barrier at both ends perpendicular to the pair of parallel panes.

* * * * *